US006421018B1

(12) United States Patent
Zeilinger et al.

(10) Patent No.: US 6,421,018 B1
(45) Date of Patent: Jul. 16, 2002

(54) BOWTIE INDUCTIVE COUPLER

(75) Inventors: Steven Zeilinger, Carol Stream; Will Darden, Naperville, both of IL (US)

(73) Assignee: Andrew Corporation, Addison, IL (US)

( * ) Notice: Subject to any disclaimer, the term of this patent is extended or adjusted under 35 U.S.C. 154(b) by 0 days.

(21) Appl. No.: 09/871,040

(22) Filed: May 31, 2001

(51) Int. Cl.[7] ..... H01Q 1/32
(52) U.S. Cl. ..... 343/713; 343/767
(58) Field of Search ..... 343/713, 711, 343/767, 770, 700 MS, 712; H01Q 1/32

(56) References Cited

U.S. PATENT DOCUMENTS 5,404,146 A * 4/1995 Rutledge ..... 343/720
5,696,372 A * 12/1997 Grober et al. ..... 250/216
RE36,076 E * 2/1999 Bryant et al. ..... 343/713
5,995,821 A * 11/1999 Tran ..... 455/345
6,069,588 A * 5/2000 O'Neill, Jr. ..... 343/713
6,265,977 B1 * 7/2001 Vega et al. ..... 340/572.7
6,285,331 B1 * 9/2001 Jesman et al. ..... 343/713

* cited by examiner

*Primary Examiner*—Hoanganh Le
*Assistant Examiner*—Trinh Vo Dinh
(74) *Attorney, Agent, or Firm*—Vedder, Price, Kaufman & Krammholz

(57) ABSTRACT

A coupler for use in wireless communications systems that is particularly useful in broadband applications includes a pair of coupling elements that are mounted on the interior and exterior surfaces of a vehicle, such as a rear window. Both coupling elements have dielectric substrates mounted within housings and each of the substrates includes a dual "bowtie" arrangement. This arrangement includes a first bowtie that is etched onto the substrate to remove the conductive upper layer and a second bowtie formed of conductive material and positioned within the first bowtie and spaced apart from its boundaries so as to define a slot separating the two.

23 Claims, 4 Drawing Sheets

BOWTIE INDUCTIVE COUPLER

BACKGROUND OF THE INVENTION

The present invention relates generally to portable wireless communications systems, and more particularly to an improved coupling device used with such communication systems.

Wireless communications systems are in wide use. These systems are used to transmit both voice and data over cellular and other communications systems. The first cellular telephone systems were analog systems that operated in a frequency band from around 800 MHz to 960 MHz. Newer, digital communication systems operate in PCN or PCS networks at higher frequency bands of between about 1500 to about 2400 MHz. The frequency bands have been expanded for currently, the cellular frequencies for most North American cellular systems include two frequency bands: 824–894 MHz for the AMPS band and 1.85–1.99 GHz for the PCS band. In Europe these two bands are slightly different and include 890–960 MHz for GSM and 1.71–1.88 GHz for the PCN band, with some communication frequencies being as high as 2.17 GHz.

Systems that operate in both these bands are preferred so that communication can be supplied to a system user regardless of the equipment the user or system operates. In order to complement the operation of the system, it is desirable to efficiently couple a system antenna to the telephone or other apparatus. A coupler is a device that is used to couple radio-frequency (RF) signals between two components of a system, such as in a mobile telephone system, the exterior antenna and the interior coaxial cable and vice-versa. The couplers permit window mounting, and are mounted on opposite sides of a mounting surface which is typically a portion of one of the windows of a vehicle.

Typically, these couplers are structured to operate only in a single narrow frequency band. Other couplers, such as that described in U.S. Pat. No. 6,069,588, issued May 30, 2000 are complex in structure because they utilize multiple electronic components as part of the coupler. Still other couplers, like that described in U.S. Pat. No. 5,995,821 issued Nov. 30, 1999 uses multi-part coupling elements that must be oriented at desired angles and distances to each other in order to efficiently operate. In order to accommodate cellular and mobile telephones that operate in multiple cellular bands, a coupler itself must be capable of transferring RF signals through the medium upon which it is mounted with minimal signal loss.

A need therefore exists for an improved coupler that operates efficiently in multiple frequency bands with a simple structure, and which has minimal signal loss in operation. The present invention is directed to such a coupler.

SUMMARY OF THE INVENTION

It is therefore a general object of the present invention to provide an improved coupler that operates within dual frequency bands of wireless communication systems.

It is another object of the present invention to provide a simple and inexpensive coupler that efficiently couples RF signals in a wide bandwidth of from about 800 to about 2000 MHz.

It is yet another object of the present invention to provide an improved coupler for use with wireless telecommunication systems that includes a bowtie slot formed within a layer of conductive material on the surface of a circuit board and which is fed from a feedline on the opposite side of the circuit board, the feeding occurring at the apex of the bowtie.

Still another object of the present invention is to provide an improved dual band-operative coupler of small size that encompasses all present bands of cellular communication frequencies and that includes a pair of dielectric bases adapted for respective attachment to opposite sides of a glass surface of either a vehicle or building, the bases having opposing first and second sides, the second sides of the bases each including a layer of conductive material disposed thereon, and, a pair of bowtie slots formed thereon in alignment with each other so that one bowtie slot is located within the other bowtie slot, the two bowtie slots being separated from each other by an intervening layer of conductive material, each base further including a feed point that provides a feed point providing a feed connection through the dielectric stratum to the apexes of the two bowties.

Yet a still further object of the present invention is to provide a coupler incorporating a pair of bowtie-shaped slots of the structure set forth above and further including a tuning network extending along an opposite surface of the support and connecting to the bowtie element(s) at an associated apex portion thereof.

The present invention accomplishes these objects and advantages through its novel and unique structure. In one principal aspect of the present invention, a coupling element is provided for attachment to an interior surface of a vehicle or building, preferably a window. The coupler includes a housing, a coaxial transmission line and a dielectric support board disposed within the housing. One side of the board that faces toward the interior surface of the window has a layer of conductive material formed thereupon. A pair of slots are formed in the conductive material, in the form of inner and outer slots. The outer slot has the shape of a bowtie in which a pair of triangular-shaped members are joined together at their apexes. The inner slot also has the shape of a bowtie and the inner slot is separated from the outer slot by an extent of conductive material. The two bowtie slots are preferably oriented along common axes, and the intervening conductive layer that separates them from each other also has a bowtie shape, or a shape that approximates an angled lemniscate. The first and second bowties are separated at their apexes by the opening. The other side of the dielectric board supports the transmission line which is terminated to the coupler by way of a passage, or via, that extends through the board and which communicates with the apex of the bowtie.

In another principal aspect of the present invention, the transmission line may be terminated to a conductive tuning network disposed on the opposite side of the dielectric board. This network may include a serpentine pattern of conductive material, such as foil that may be arranged to provide the desired frequency. The bowtie pattern can be easily formed on the dielectric boards by etching the conductive material disposed on the surfaces thereof. Conventional circuit board material may be used for the substrate such as phenolic, copper-clad or laminated sheets or epoxy-based or fiberglass fabric sheets coated with a conductive layer.

These and other objects, features and advantages of the present invention will be clearly understood through consideration of the following detailed description.

BRIEF DESCRIPTION OF THE DRAWINGS

In the course of the following detailed description, reference will be frequently made to the accompanying drawings in which.

DESCRIPTION OF THE PREFERRED EMBODIMENTS

Known couplers that have been used in the telecommunications field are typically small in size and are mostly capable of performance in a tight range of frequencies. They do not operate well in wide frequency ranges. The present invention performs well across all frequencies from 824 MHz to about 2 Ghz, which includes the AMPS (824–894 MHz), GSM (890–960 MHz), PCN (1710–1880 MHz) and PCS (1850–1990 MHz) bands. The present invention provides a coupler that effectively transmits radio frequency ("RF") signals through a window, or other dielectric across a wide bandwidth ranging from about 829 MHz to about 2 to 3 GHz. It is contemplated that the present invention will perform as well for future communication systems, such as the European UMTS with a maximum frequency of 2.17 GHz and even up to anticipated frequencies of 3 GHz.

Figure 1:
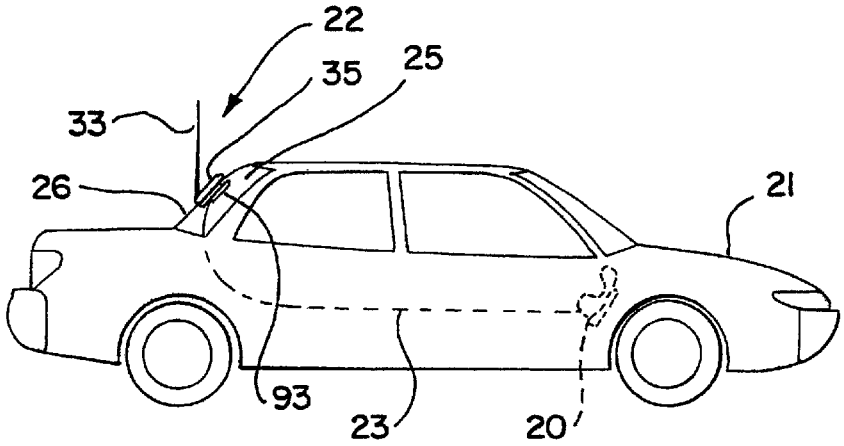
FIG. 1 is a schematic diagram illustrating a vehicle environment in which the present invention finds utility.

In its most useful application, that of mobile communications, as illustrated in FIG. 1, a typical mobile communications system is seen to include a wireless telephone, or receiver, 20 that is disposed within the vehicle 21, an antenna 22 and a transmission line 23 interconnecting the two. The antenna 22 may include a module 29 having a swivel mount 30 that is attached to a plate or dielectric board 31 and which supports a radiating element 33. The radiating element 33 may have its own particular structure that may be detachably mounted by way of a screw base 34 that permits the radiating element 33 to be selectively rotated back and forth between two flanges 36. The swivel mount 30 and its supporting board 31 are typically mounted in a housing 35 that protects the board 31 and any circuitry thereon, from the environment. An adhesive layer, using a pressure-sensitive adhesive or the like covers the underside 36 of the board 31 and serves to attach the entire assembly to an exterior surface 25 of the vehicle 21, such as the rear window 26.

Figure 2:
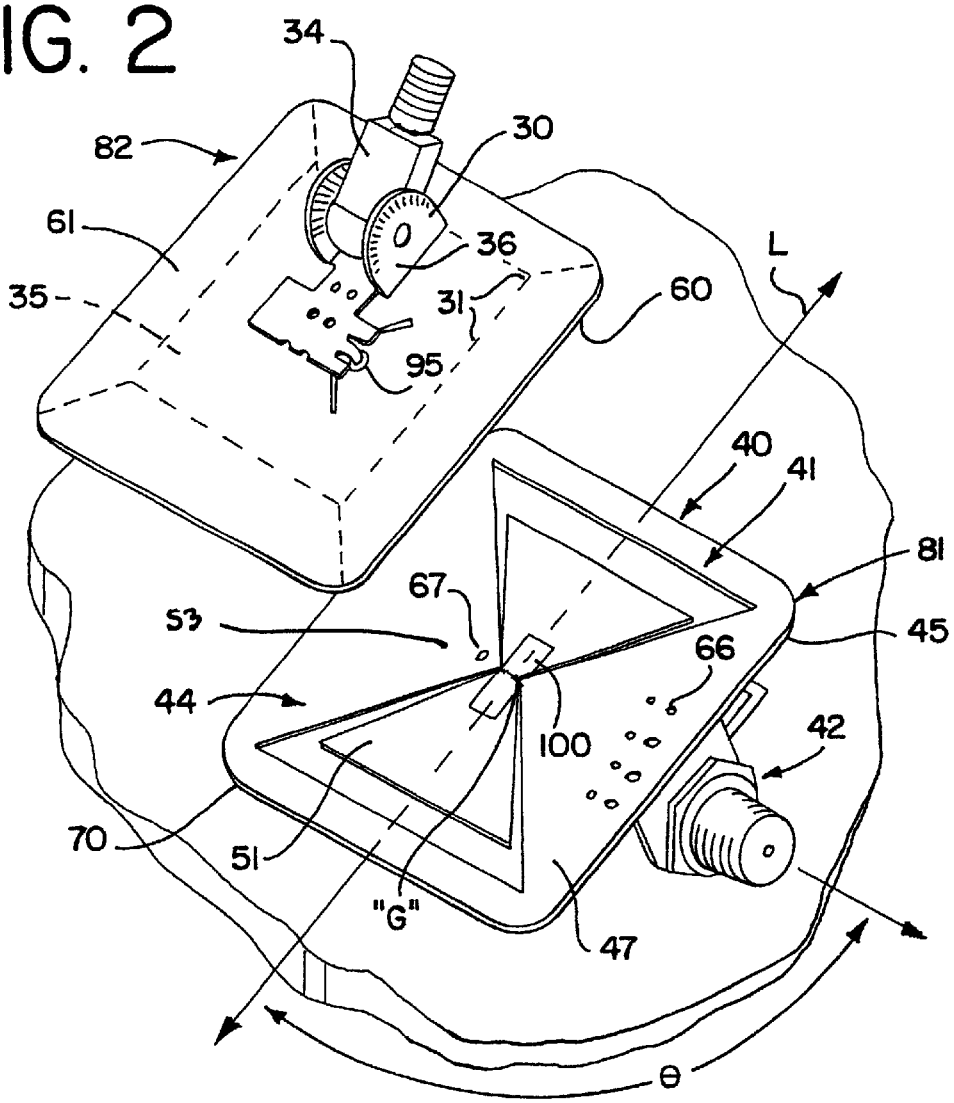
FIG. 2 is a partial exploded perspective view looking at the exterior antenna mount through a glass interface at the interior coupler member of the coupler of the present invention.
Figure 4:
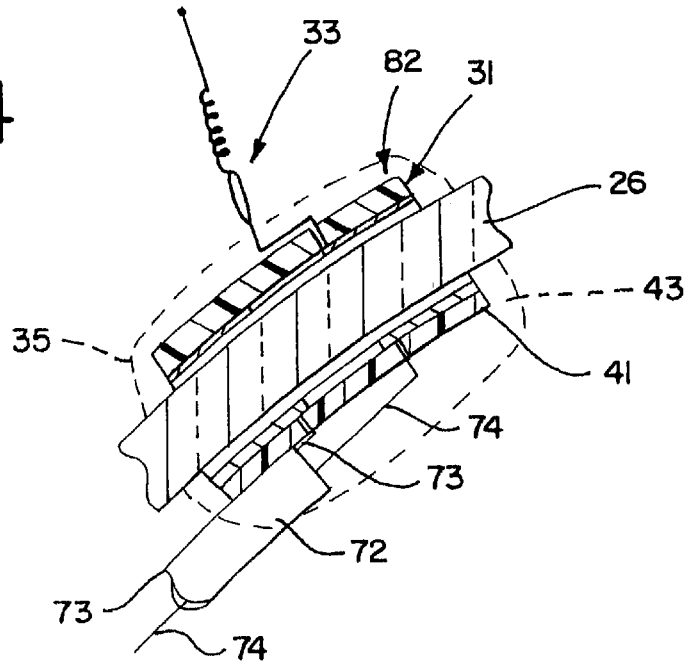
FIG. 4 is a diagrammatic, sectional view of a coupler assembly of the present invention mounted on a glass window and terminated to a radiating element on the exterior and to a coaxial transmission line on the interior.

In order to effectively pass RF signals through the vehicle's exterior surface 25 (typically a glass window), a coupler assembly 40, is provided. It will be understood that the present invention refers to a coupling assembly which passes signals through an interface, such as a vehicle window 26, as opposed to an antenna that actually receives and transmits RF signals. The coupler assembly 40 is attached to a separate antenna radiating element 33, as shown in FIGS. 1, 2 and 4. FIG. 4 diagrammatically illustrates the use of couplers of the present invention and they can be seen to include an external coupling element 82 that is affixed to a vehicle exterior surface, preferably a glass window 26, and an internal coupling element 81 that is affixed to a vehicle interior surface. The external coupling element 82 supports and is connected to an antenna radiating element 33, while the internal coupling element 81 is connected to and supports a transmission line, such as a coaxial cable 72, having an inner signal conductor 74 surrounded by a dielectric cover, which in turn is surrounded by a conductive outer shield 73. The two coupling elements 31, 41 are typically housed in respective housings 35 and 43.

Figure 3:
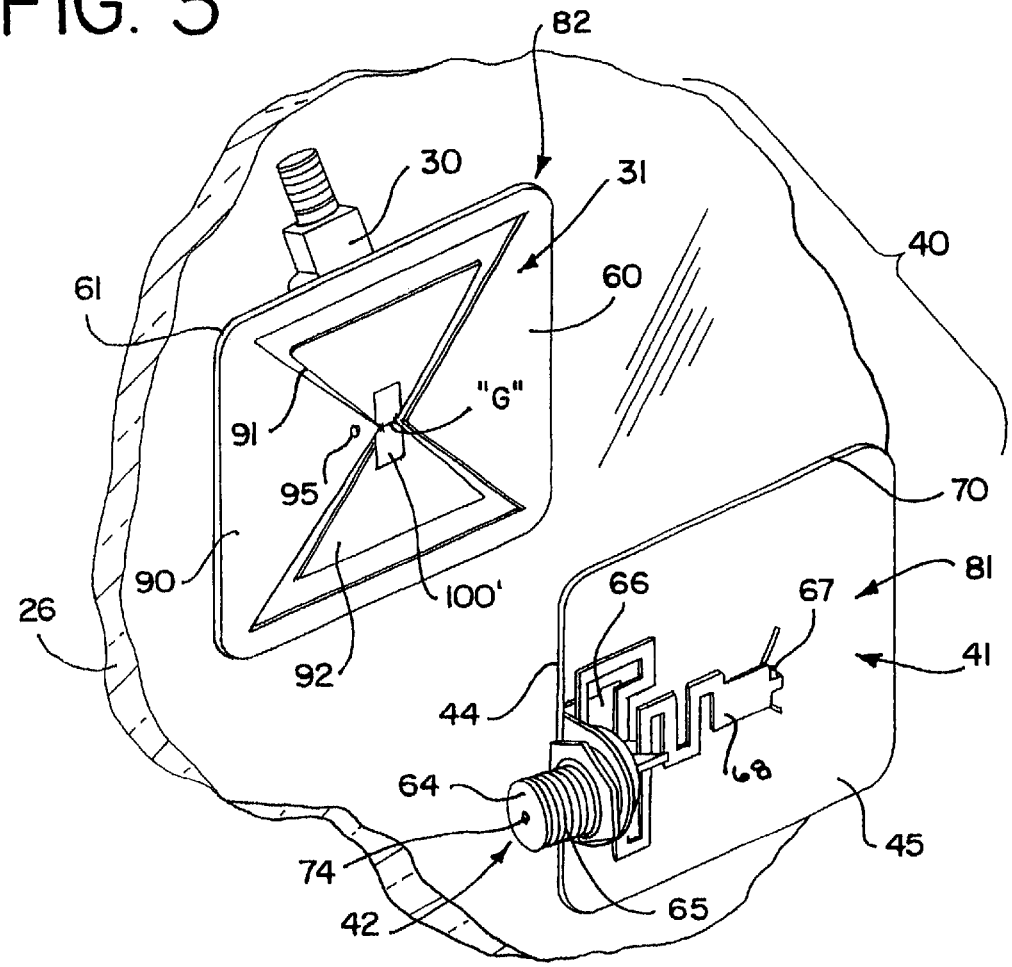
FIG. 3 is the same view as FIG. 2, but from the interior side of the glass interface illustrating the coupler member used with the exterior antenna mount.

FIG. 2 illustrates the face of the internal coupling element 81 best, while FIG. 3 illustrates the face of the external coupling element 82. These two faces oppose each other in installation, as shown in FIG. 4. The internal coupling element 81 of the coupler assembly 40 includes a dielectric support board 41 with two, opposite surfaces 44, 45, a coaxial transmission line to board connector 42 that is mounted to the surface 45 of the board 41. A housing 43, shown in phantom in FIG. 4, may be provided that encloses the board and the connector 41 two components. Similarly, the external coupling element 82 includes a dielectric board 31 and an antenna radiating element support structure 30, all of which are typically enclosed within a housing 35, shown in phantom in FIGS. 2 and 4. In use, the internal coupling element 81 is mounted on the interior surface of the vehicle glass 26 as illustrated in alignment with the external coupling element 82.

It has been discovered that the use of a particular slot pattern on the dielectric support boards 31, 41 permits the coupler to effectively pass, or transmit, RF signals over a wide band of frequencies that range from about 800 MHz to about 2.0 GHz through the glass of the vehicle. This coupler permits the use of a multi-band antenna on the vehicle without drilling through the body of the vehicle to connect the external antenna radiating element 33 to the internal transmission line 72. Each coupling element 81, 82 includes a dielectric board with two surfaces. The internal coupling element support board 41 has two opposing surfaces 44, 45, with the former surface 44 being referred to herein as the "inner" surface in that it faces and abuts the window glass 26 of the vehicle window, and the latter surface 45 being referred to herein as the "outer" surface of the internal coupling element 81 in that it faces outwardly with respect to the window glass. Similar terminology holds for the exterior coupler module that also supports the antenna 33, with the "inner" surface 60 thereof facing the window interior surface, or the plane of the paper in FIG. 2 and the "outer" surface 61 facing away from the window.

Figure 6:
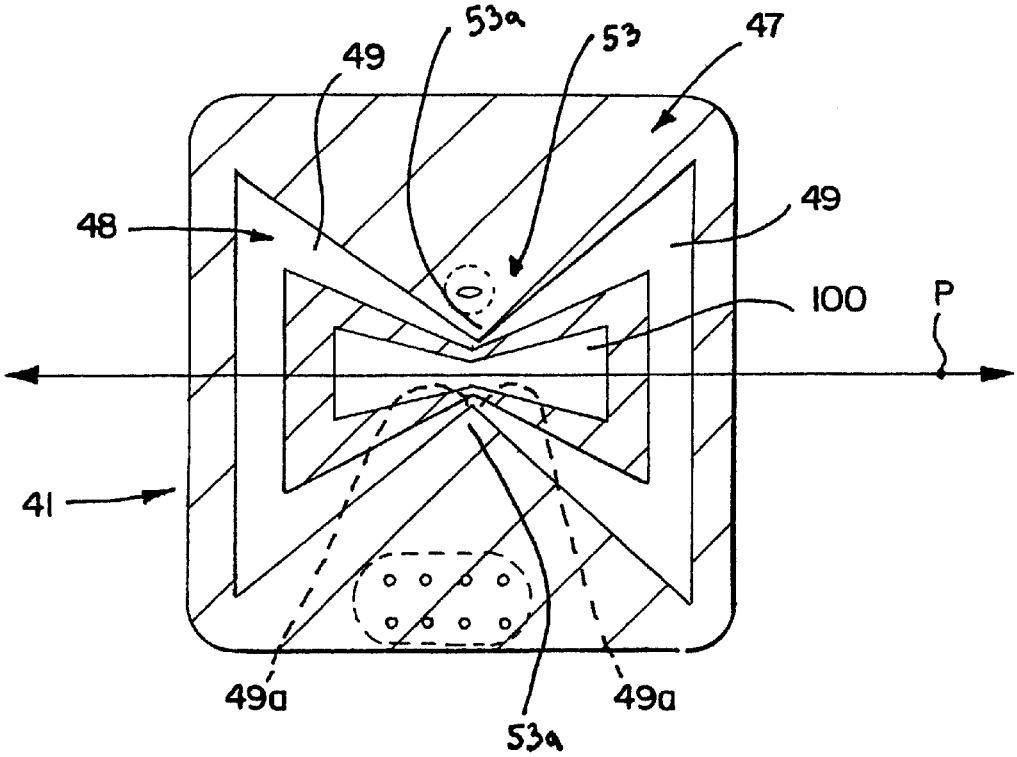
FIG. 6 is a plan view of the internal coupling element of the invention illustrating the geometric relationship of the bowtie portions of the coupling elements; and, FIG. 7 is a schematic view of another embodiment of the invention, utilizing a "rounded" bowtie-slot design.
Figure 7:
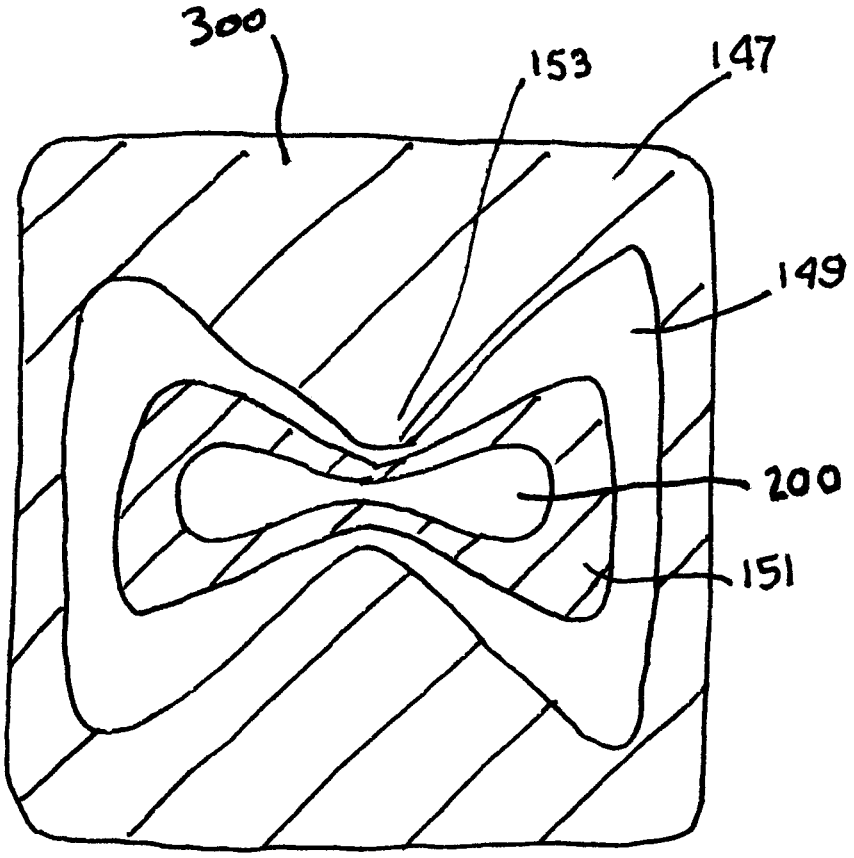

Each of the two coupler members has a unique pattern that imparts the unexpected coupling in a wide frequency band. As shown in FIGS. 2 & 4, and particularly, FIG. 4, the internal coupling element support board 41 can be seen to include a first layer of conductive material 47 applied to its inner surface 44. This and other conductive material used on the support board 41 is shaded in FIG. 4 for clarity. This layer 47 is preferably formed as a continuous layer on the inner surface 44 of the support board 41 as would normally be found on a copper-clad circuit board, and it preferably extends to or near the edge 70 of the support board 41. This conductive material may include thin films, foils or plates formed from copper, brass, gold, steel, alloys thereof or any conductive material. A non-conductive area is formed in the conductive layer 47 by removing a selected amount and extent of the first conductive layer 47 in order to define a non-conductive "slot", or "aperture", 48 within the first conductive layer 47. This slot 48, as illustrated best in FIG. 6, is formed from two areas 49 that are illustrated as triangular-shaped and which are oriented thereon so that their respective apexes 49*a* either meet or intersect together in the central part of the board 41 as illustrated. Both triangular shapes are preferably the same size so that the slot 48 is symmetrical about a longitudinal axis L of the support board 41, shown in FIG. 2, as well as a transverse axis T of the support board 41, shown in FIG. 6. These two axes may be considered as axes of symmetry insofar as the conductive layers and non-conductive slots are concerned. The mating of these two triangular areas 49 cooperatively provide an overall bowtie-shaped configuration of the slot 48. This slot 48 defines the lower end of frequency bandwidth in which the coupler assembly 40 operates. The intersection of the two triangular-shaped areas 49 serve also to define two apexes 53*a* of two generally triangular-shaped conductive areas 53 that are offset with respect to the non-conductive areas 49 and which are oriented along the longitudinal axis of symmetry L of FIG. 2. Although triangular-shaped slots are illustrated in the drawings, it will be understood that the slots need not be exact triangles. For example, the corners thereof may be rounded, rather than being formed of two intersecting lines, as illustrated in FIG. 7.

In an important aspect of the present invention, a second conductive layer of material 51 is disposed on the internal coupling element support board 41. The term "second" is used herein to describe this layer 51 only in the sense that it is separated from the first layer 47 of conductive material by the bowtie slot 48. Both the first and second layers 47, 51 may be part of the original conductive facing on the board 41, portions of which may be removed in a conventional manner, such as photo-etching, in order to form the bowtie slot 48. This second conductive layer 51 may be considered as an insert that is placed within the slot 48 and thus it may be formed by applying a second conductive layer to the support board separate from the first conductive layer 51.

The second conductive layer 51 also has the configuration of a bowtie as illustrated, but this second bowtie 51 is smaller in dimension than the bowtie non-conductive slot 48 so that the second conductive area 51 lies entirely within, or is encompassed by, the non-conductive slot 48. The slot 48 itself may also be considered as having a general bowtie shape, or at least in outline, and may further be considered as having the configuration of an angled partial lemniscate (the mathematical symbol used to represent infinity and which is similar to a figure-eight), similar to what is illustrated in FIG. 7. The internal coupling element 81 thus presents two conductive areas that are separated by an intervening dielectric slot.

The inner coupling element transmission line, or coaxial cable 72, is terminated to the inner surface 44 of the internal coupling element 81. As illustrated in FIG. 3, the coaxial connector 42 has a center opening 64 that is adapted to receive the center conductor 74 of the coaxial transmission cable 72 and which is surrounded by a dielectric material, which in turn, is surrounded by a conductive threaded collar 65. The collar 65 mates with a coupling attached to the cable and terminated to the cable inner shield 73. In order to terminate or connect this grounded shield of the cable to the internal coupling element 81, the internal coupling element 81 has a series of vias, or passages, 66 through which conductive material, such as solder, may extend to provide an electrical connection between the cable grounding shield and the first conductive layer 47, near the edge 70 of the support board 41.

The signal conductor of the coaxial cable 72 is also terminated to the first conductive layer 47, but in an area spaced apart from the location of connection of the cable grounding shield 73. This is effected by way of another via 67 that is located near the apex of one of the triangles formed by the first conductive layer 47. This termination acts as a feed port for the coupler assembly and in order to provide the most effective feeding, it is desired to locate this termination near the apex of the triangles but across a gap formed by the non-conductive slot 48 of the support board 41. The feedline that extends to the via 67 may utilize a conductive stripline 68 as shown in FIG. 3 that extends from the coaxial connector 42 near the edge 70 of the internal coupling element 81 across the gap "G" (FIG. 2) formed by the intersection of the two triangles 49 that cooperatively form the bowtie slot 48. The stripline 68 may incorporate a serpentine pattern as shown to "tune" the feedline by matching the impedance of the antenna radiating element 33. The termination of the feedline from the coaxial cable 72 may be considered as occurring near the convergence of the apexes 49*a* of the triangular-shaped areas 49 that make up the bowtie slot, and near the convergence of the apexes 53*a* of the triangular-shaped areas 53 of the first conductive layer 47.

A similar structural arrangement occurs on the support board 31 of the external coupling element 82 in that the inner surface 60 thereof includes a first conductive layer 90 that encompasses a non-conductive slot 91, also having a bowtie shape. The external coupling element 82 further includes a conductive insert, or second layer 92 that is contained within the non-conductive slot 91. In order to obtain optimum performance, the second layer of conductive material 92 is also preferably separated from the first conductive layer 90 by the intervening slot 91. The second support board 31 also has a via 95 (FIGS. 2 & 3) by which the antenna radiating element 33 is terminated to the first conductive layer 90, by way of soldering or the like. This termination also occurs near the gap "G" between the apexes of the first conductive layer 90 and the intersection of the apexes of the two non-conductive triangles that cooperatively form the bowtie non-conductive slot 91 of the second coupling element.

It has been found that the bowtie slots 48 and 91, provide a means for coupling RF signals at the low end of the desired operational frequency bandwidth extending from between about 800 MHz to about 1000 MHz (1 GHz) which will cover the AMPS frequency band in North America and the GSM frequency band in Europe. The inner conductive bowties 51, 92 provide a means of tuning the coupler and serves to extend, or broaden, the frequency bandwidth of the coupler assembly 40. The first conductive layers 47, 90 act as groundplanes for their respective coupling elements.

For the coupler element shown in FIG. 4, the following dimensions have been determined to provide operation that encompasses both the AMPS bandwidth of 824–894 MHz and the PCS bandwidth of 1850–1990 MHz:

| |
|---|
| A = 50 mm |
| B = 42 mm |
| C = 33 mm |
| D = 50 mm |
| E = 42 mm |
| F = 30 mm |

Although other shapes are believed to operate in a similar manner, it is believed that the triangular shape illustrated offers best performance. In order to tune the performance of the coupler, the dimensions of the non-conductive slots 48, 91 may be adjusted (i.e., the depth and width thereof) to gain the most efficient performance of the coupling assembly 40.

Figure 5:
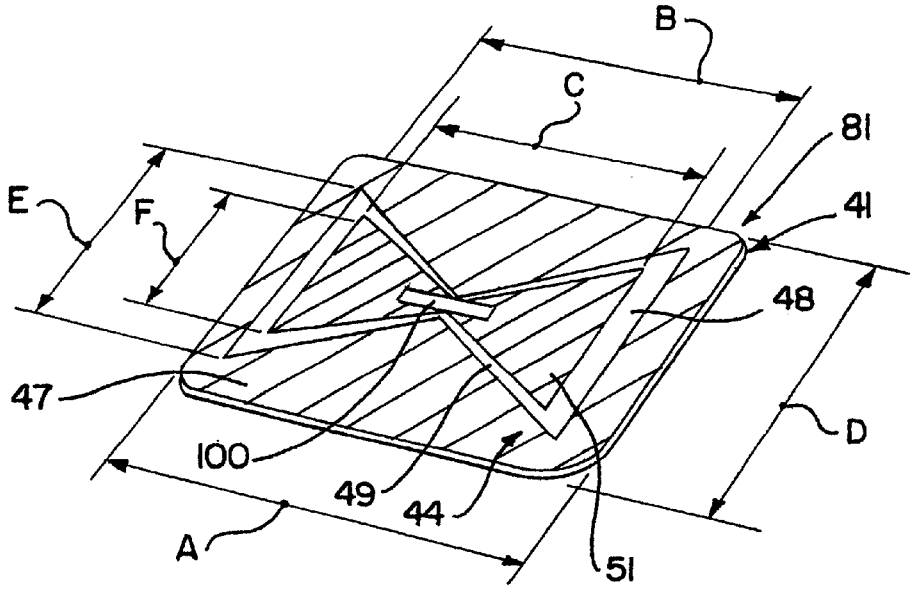
FIG. 5 is a perspective, diagrammatic view of one of the two coupler members of the present invention illustrating the structural relationship and dimensions thereof.

A second slot 100, 100' may be provided for the system in the center areas of the conductive bowtie inserts 51, 92 that extends within the boundaries thereof in order to add a reactive load to the input impedance of the coaxial transmission line 72. This second slot may be rectangular as illustrated in FIGS. 2, 3 & 5, or it may have a slight bowtie configuration as illustrated in FIG. 6.

FIG. 7 illustrates another embodiment of a coupler element 300 in which the angled edges or corners of the slots have been rounded. The conductive layer 147 has a rounded slot 149 formed therein, and that in turn has a rounded conductive insert 151, with its own corresponding rounded slot 200. The apexes 153 of the conductive layer 147 are likewise rounded. Similar performance is believed to be attained using such an embodiment.

While the preferred embodiments of the invention have been shown and described, it will be apparent to those skilled in the art that changes and modifications may be made therein without departing from the spirit of the invention, the scope of which is defined by the appended claims. For example, the bowtie configuration may be modified to reduce its dimensions, increase its dimensions or to change its overall configuration, provided that a second conductive layer or insert is maintained within the slot and isolated from the first conductive layer.

What is claimed is:

1. A coupler for transferring radio frequency signals across a broad bandwidth of signals and through a vehicle window, comprising:

first and second coupling elements, the first coupling element being capable of being fixed to an interior surface of the vehicle window, the second coupling element being capable of being fixed to an exterior surface of said vehicle window;

the first coupling element including a first support board having first and second opposing surfaces, the first surface of the first support board being oriented in opposition to the vehicle window interior surface, said first support board first surface having a first layer of conductive material disposed thereon, a slot disposed in said first conductive material layer on said first support board first surface defining a non-conductive area upon said first support board first surface, said first slot having a bowtie configuration, the bowtie configuration including two triangle-shapes joined together at opposing apexes thereof;

said first coupling element further including a second layer of conductive material disposed on said first support board first surface within said first slot, the second conductive material layer having a bowtie configuration, said second conductive material layer being smaller in size than said first slot such that said first slot isolates said second conductive material layer from said first conductive material layer;

the second coupling element including a second support board having first and second opposing surfaces, the first surface of the second support board being oriented in opposition to the vehicle window exterior surface, said second support board first surface having a first layer of conductive material disposed thereon, a slot disposed in said second support board first layer of conductive material on said second support board first surface defining a non-conductive area upon said second board first surface, said second coupling element first slot having a bowtie configuration, the bowtie configuration including two triangle-shapes joined together at opposing apexes thereof;

said second coupling element further including a second layer of conductive material disposed on said second board first surface within said second coupling element first slot thereof, the second support board second layer of conductive material having a bowtie configuration, and being smaller in size than said second coupling element first slot such that said second coupling element first slot isolates said second support board second layer of conductive material from said second support board first layer of conductive material.

2. The coupler of claim 1, wherein said first coupling element further includes a coaxial connector disposed on said first support board second surface, said coaxial connector having two terminals for terminating two conductors of a coaxial cable to said first coupling element.

3. The coupler of claim 2, wherein one of said coaxial connector terminals is terminated to said first support board first layer of conductive material on one side of an axis of symmetry of said first coupling element first support board.

4. The coupler of claim 3, wherein said other of said coaxial connector terminals is terminated to said first support board first layer of conductive material on an opposite side of said first coupling element first support board axis of symmetry.

5. The coupler of claim 4, wherein said first support board includes at least first and second vias extending therethrough, the vias defining pathways for terminating said coaxial connector terminals to said first support board first layer of conductive material, and said vias being disposed on opposite sides of an axis of symmetry of said first support board.

6. The coupler of claim 3, wherein said first support board second surface includes a stripline disposed thereon defining a tuning network that interconnects said one coaxial connector terminal to said first layer of conductive material.

7. The coupler of claim 6, wherein said tuning network includes an extent of conductive material arranged in a serpentine pattern on said first support board second surface.

8. The coupler of claim 1, wherein said second coupling element includes an antenna radiating element disposed on said second support board second surface, the antenna radiating element being connected to said second support board first layer of conductive material.

9. The coupler of claim 1, wherein said first coupling element includes a second slot disposed on said first support board first surface defining a second non-conductive area of said first support board, the second non-conductive area being disposed within said second conductive material layer.

10. The coupler of claim 9, wherein said first coupling element second slot includes a rectangular slot.

11. The coupler of claim 1, wherein said first coupling element second slot is disposed in a central portion of said first support board second conductive material layer.

12. The coupler of claim 1, wherein said first slots of each of said first and second coupling elements have the same dimensions.

13. The coupler of claim 1, wherein said second conductive material layers of each of said first and second coupling elements have the same dimensions.

14. The coupler of claim 9, wherein said second coupling element also includes a second slot disposed on said second support board first surface and within said second support board first layer of conductive material thereon.

15. The coupler of claim 14, wherein said second coupling element second slot includes a rectangular slot.

16. The coupler of claim 14, wherein said second coupling element second slot is disposed in a central portion of said second conductive material layer thereon.

17. The coupler of claim 13, wherein said first and second coupling element second slots have the same dimensions.

18. The coupler of claim 1, wherein said first and second coupling element first slot bowtie configurations have rounded corners.

19. The coupler of claim 1, wherein said first and second coupling element first slot bowtie configurations have angled corners.

20. A coupler for transferring broad bandwidth radio frequency signals through a vehicle window, comprising:

first and second coupling elements, the first coupling element being capable of being fixed to an interior surface of the vehicle window, the second coupling element being capable of being fixed to an exterior surface of the vehicle window;

the first coupling element including a first board having first and second opposing surfaces, the first surface of the first board being oriented in opposition to the vehicle window interior surface, said first board first surface having a first layer of conductive material disposed thereon, a slot disposed in said first conductive material layer on said board first surface defining a non-conductive area upon said first board first surface, said first slot having a bowtie configuration, the bowtie configuration including two triangle-shapes joined together at opposing apexes thereof;

said first coupling element further including a second layer of conductive material disposed on said first board first surface within said first slot, the second conductive material layer having a bowtie configuration, said second conductive material layer being smaller in size than said first slot such that said first slot isolates said second conductive material layer from said first conductive material layer, said first coupling element further including a second slot disposed on said first board first surface within said second conductive material layer;

the second coupling element including a second board having first and second opposing surfaces, the first surface of the second board being oriented in opposition to the vehicle window exterior surface, said second board first surface having a first layer of conductive material disposed thereon, a slot disposed in said second support board first layer of conductive material on said second board first surface defining a non-conductive area upon said second board first surface, said second coupling element first slot having a bowtie configuration, the bowtie configuration including two triangle-shapes joined together at opposing apexes thereof, said second coupling element further including a second layer of conductive material disposed on said second board first surface within said first slot thereof, the second conductive material layer having a bowtie configuration, said second conductive material layer being smaller in size than said first slot such that said first slot isolates said second conductive material layer from said first conductive material layer, said second coupling element further including a second slot disposed on said first board first surface within said second conductive material layer.

21. The coupler of claim 20, wherein each of said first and second coupling element second conductive material layers have the same dimensions.

22. The coupler of claim 21, wherein each of said first and second coupling element second slots have the same dimensions.

23. A coupler for establishing a communication path between a wireless telephone inside of a vehicle and an antenna radiating element exterior of the vehicle, the coupler permitting communication between the exterior antenna in a radio frequency range bandwidth of between about 0.8 GHz and 1.5 GHz, the coupler comprising:

an internal coupling element that is mountable to an inner surface of the vehicle and which is connectable to said wireless telephone by way of a transmission line, the internal coupling element including a first base member formed from a dielectric material and having first and second opposite sides, the first side of said first base member having a first conductive layer disposed thereon in opposition to said vehicle inner surface, the first base member first conductive layer of material having a first non-conductive slot disposed therein, the first non-conductive slot having a bowtie configuration formed by two triangles joined at opposing apexes, said first base member further including a second layer of conductive material disposed within said first non-conductive slot, the second layer of conductive material also having a bowtie configuration that is smaller than said first non-conductive slot so as to be entirely contained within said first non-conductive slot without contacting any portion of said first conductive layer; and, an external coupling element that is mountable to an exterior surface of said vehicle and which is connectable to said antenna radiating element, the external coupling element including a second base member formed from a dielectric material and having first and second opposite sides, the first side of said second base member having a first conductive layer disposed thereon in opposition to said vehicle exterior surface, the second base member first conductive layer of material having a first non-conductive slot disposed therein, the second base member first non-conductive slot having a bowtie configuration formed by two triangles joined at opposing apexes, said second base member further including a second layer of conductive material disposed within said second base member first non-conductive slot, the second base member second layer of conductive material also having a bowtie configuration that is smaller than said second base member first non-conductive slot so as to be entirely contained within said second base member first non-conductive slot without contacting any portion of said second base member first conductive layer.

* * * * *